US011443702B2

(12) United States Patent
Tomitani

(10) Patent No.: US 11,443,702 B2
(45) **Date of Patent: *Sep. 13, 2022**

(54) DISPLAY DEVICE AND DISPLAY SYSTEM

(71) Applicant: Japan Display Inc., Tokyo (JP)

(72) Inventor: Hisashi Tomitani, Minato-ku (JP)

(73) Assignee: Japan Display Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/345,579

(22) Filed: Jun. 11, 2021

(65) Prior Publication Data

US 2021/0304688 A1 Sep. 30, 2021

Related U.S. Application Data

(62) Division of application No. 16/775,370, filed on Jan. 29, 2020, now Pat. No. 11,094,269.

(30) Foreign Application Priority Data

Jan. 31, 2019 (JP) ..... JP2019-016479

(51) Int. Cl.
*G09G 3/34* (2006.01)
*G09G 3/36* (2006.01)

(52) U.S. Cl.
CPC ..... *G09G 3/3413* (2013.01); *G09G 3/36* (2013.01); *G09G 3/3614* (2013.01); *G09G 3/3655* (2013.01); *G09G 2310/0235* (2013.01); *G09G 2320/064* (2013.01); *G09G 2320/0633* (2013.01); *G09G 2320/0666* (2013.01); *G09G 2360/144* (2013.01)

(58) Field of Classification Search
None
See application file for complete search history.

(56) References Cited

U.S. PATENT DOCUMENTS 9,165,521 B2 * 10/2015 Yamazaki ..... G09G 3/3677
2003/0107538 A1 * 6/2003 Asao ..... G09G 3/3413 345/87
2005/0117190 A1 * 6/2005 Iwauchi ..... H05B 45/20 359/237
2007/0177239 A1 * 8/2007 Tanijiri ..... G02B 27/0172 359/13

(Continued)

FOREIGN PATENT DOCUMENTS

JP 2010-097420 A 4/2010

*Primary Examiner* — Parul H Gupta
(74) *Attorney, Agent, or Firm* — Maier & Maier, PLLC

(57) ABSTRACT

A display device includes: a liquid crystal display panel including a liquid crystal between two substrates; and first, second, and third light sources emitting light in different colors. A light emission period includes a first light emission period is which luminance of the first light source is higher than luminance of the second and third light sources, and at least one of the second and third light sources emits light, a second light emission period in which the luminance of the second light source is higher than the luminance of the first and the third light sources, and at least one of the first and third light sources emits light, and a third light emission period in which the luminance of the third light source is higher than the luminance of the first and second light sources, and at least one of the first and second light sources emits light.

5 Claims, 7 Drawing Sheets

(56) References Cited

U.S. PATENT DOCUMENTS

| | | | | |
|---|---|---|---|---|
| 2007/0205969 | A1* | 9/2007 | Hagood | G02B 26/02 345/84 |
| 2009/0122087 | A1* | 5/2009 | Maruyama | G09G 3/3611 345/102 |
| 2010/0225238 | A1* | 9/2010 | Medin | H04N 9/3111 315/210 |
| 2012/0013649 | A1* | 1/2012 | Higashi | G09G 3/3413 345/690 |
| 2014/0210802 | A1* | 7/2014 | Myers | G09G 5/06 345/207 |
| 2019/0251919 | A1* | 8/2019 | Ishihara | G09G 3/3413 |

* cited by examiner

DISPLAY DEVICE AND DISPLAY SYSTEM

CROSS-REFERENCE TO RELATED APPLICATIONS

This application is a Divisional of U.S. application Ser. No. 16/775,370 filed Jan. 29, 2020, and claims priority from Japanese Application No. 2019-016479, filed on Jan. 31, 2019, the contents of each of which are incorporated by reference herein in its entirety.

BACKGROUND

1. Technical Field

The present disclosure relates to a display device and a display system.

2. Description of the Related Art

Liquid crystal display devices are knows that control each pixel so as to transmit light beams in a plurality of colors from the same pixel at different times from each other (for example, Japanese Patent Application Laid-open Publication No. 2010-097420 (JP-A-2010-097420)).

A liquid crystal display device of, for example, JP-A-2010-097420 assigns, to a light source in each color, a light emission time obtained by dividing one frame time by the number of colors of light. As a result, the light emission time of each color is shorter than that of a monochromatic light source. Thereby luminance is difficult to increase.

For the foregoing reasons, there is a need for a display device and a display system capable of more easily increasing the luminance.

SUMMARY

According to an aspect, a display device includes: a liquid crystal display panel in which a liquid crystal is sealed between two substrates facing each other; and a first light source, a second light source, and a third light source configured to emit light in colors different from one another. A light emission period in which the first light source, the second light source, and the third light source emit light includes a first light emission period in which luminance of the first light source is higher than luminance of the second light source and luminance of the third light source, and at least one of the second light source or the third light source emits light, a second light emission period in which the luminance of the second light source is higher than the luminance of the first light source and the luminance of the third light source, and at least one of the first light source or the third light source emits light, and a third light emission period in which the luminance of the third light source is higher than the luminance of the first light source and the luminance of the second light source, and at least one of the first light source or the second light source emits light.

According to another aspect, a display system includes: a display device that includes a liquid crystal display panel in which a liquid crystal is sealed between two substrates facing each other, and a first light source, a second light, source, and a third light source configured to emit light in colors different from one another; and a control device configured to output signals related to control of light emission of the first light source, the second light source, and the third light source. A light emission period in which at least one of the first light source, the second light source, or the third light source emits light includes a first light emission period in which at least the first light source emits light, a second light emission period in which at least the second light source emits light, and a third light emission period in which at least the third light source emits light. The second light source and the third light source are capable of emitting light during the first light emission period. The first light source and the third light source are capable of emitting light during the second light emission period. The first light source and the second light source are capable of emitting light during the third light emission period.

DETAILED DESCRIPTION

Figure 1:
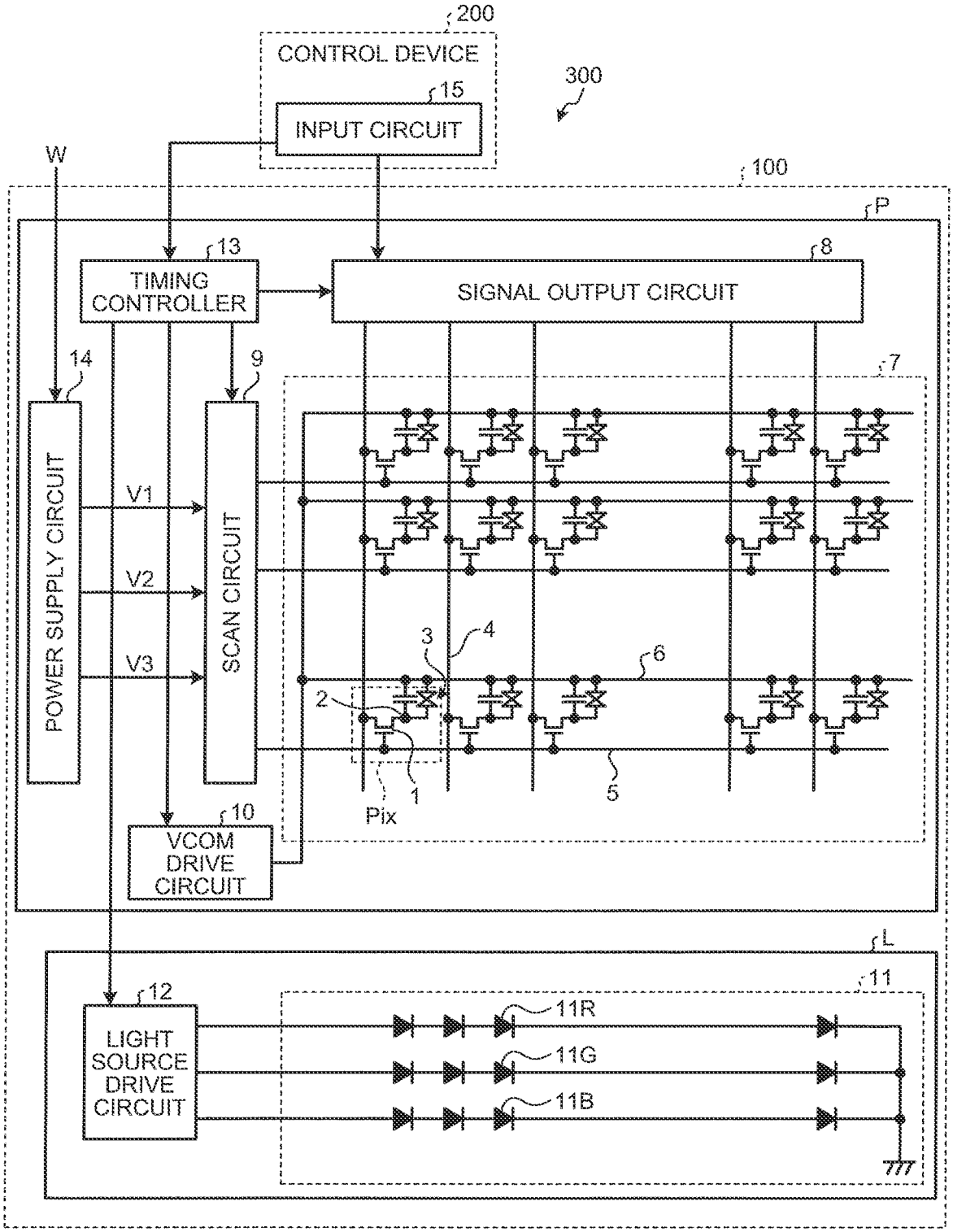
FIG. 1 is a schematic circuit diagram illustrating a main configuration of a display system.

The following describes embodiments of the present invention with reference to the drawings. The disclosure is merely an example, and the present invention naturally encompasses appropriate modifications easily conceivable by those skilled in the art while maintaining the gist of the invention. To further clarify the description, widths, thicknesses, shapes, and the like of various parts are schematically illustrated in the drawings as compared with actual aspects thereof, in some cases. However, they are merely examples, and interpretation of the present invention is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

First Embodiment

FIG. 1 is a schematic circuit diagram illustrating a main configuration of a display system 300. The display system 300 includes a display device 100 and a control device 200. The display device 100 includes a liquid crystal display panel P and a light source device L. The liquid crystal display panel P includes a display area 7, a signal output circuit 8, a scan circuit 9, a VCOM drive circuit 10, a timing controller 13, and a power supply circuit 14. Hereinafter, a display surface denotes one surface of the liquid crystal display panel P faced by the display area 7, and a back surface denotes the other surface of the liquid crystal display panel P.

Figure 2:
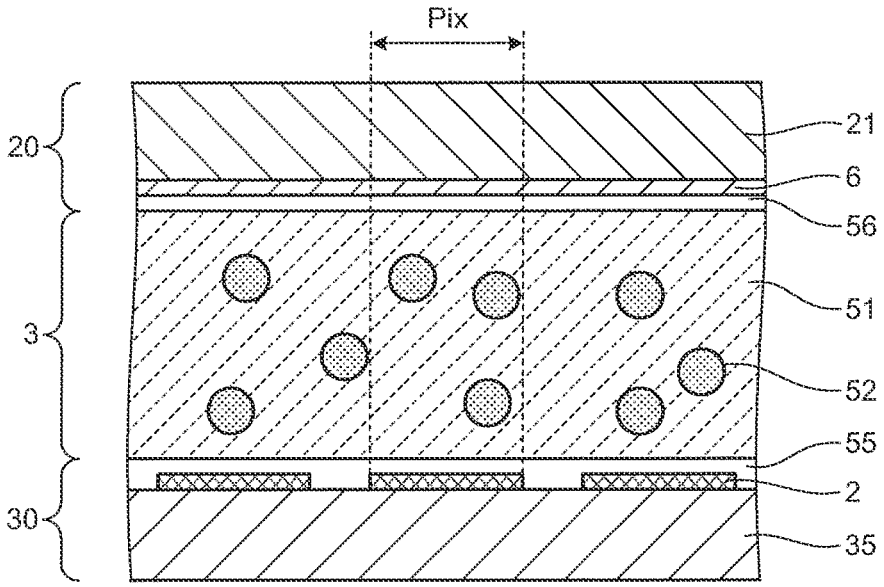
FIG. 2 is a schematic sectional view of a liquid crystal display panel.

A plurality of pixels Pix are arranged in a matrix (in a row-column configuration) in the display area 7. Each of the pixels Pix includes a switching element 1 and two electrodes. FIG. 1 and FIG. 2 (to be discussed later) illustrate a pixel electrode 2 and a common electrode 6 as the two electrodes.

FIG. 2 is a schematic sectional view of the liquid crystal display panel P. The liquid crystal display panel P includes two substrates facing each other and a liquid crystal 3 sealed between the two substrates. Hereinafter, a first substrate 30 denotes one of the two substrates, and a second substrate 20 denotes the other thereof.

The first substrate 30 includes a light-transmitting glass substrate 35, the pixel electrodes 2 stacked on the second substrate 20 side or the glass substrate 35, and an insulating layer 55 stacked on the second substrate 20 side thereof so as to cover the pixel electrodes 2. The pixel electrode 2 is individually provided for each of the pixels Pix. The second substrate 20 includes a light-transmitting glass substrate 21, the common electrode 6 stacked on the first substrate 30 side of the glass substrate 21, and an insulating layer 56 stacked on the first substrate 30 side thereof so as to cover the common electrode 6. The common electrode 6 has a plate-like or film-like shape shared among the pixels Pix.

The liquid crystal 3 or the first embodiment is a polymer dispersed liquid crystal. Specifically, the liquid crystal 3 includes a bulk 51 and fine particles 52. The fine particles 52 change in orientation in the bulk 51 in accordance with potential differences between the pixel electrodes 2 and the common electrode 6. The pixel electrode 2 is individually controlled in potential for each of the pixels Pix, and thus, the degree of at least either of optical transmission and dispersion is controlled for each of the pixels Pix. When the polymer dispersed liquid crystal is in a light-transmitting state, light incident from side surfaces of the display panel is substantially totally reflected by the first substrate 30 and the second substrate 20, and is not emitted from the display device 100. When the polymer dispersed liquid crystal is in a light-dispersing state, light is emitted from the surface to make display visible. The liquid crystal 3 may be a liquid crystal having positive dielectric constant anisotropy (positive liquid crystal) or a liquid crystal having negative dielectric constant anisotropy (negative liquid crystal).

In the first embodiment described with reference to FIG. 2, the pixel electrodes 2 face the common electrode 6 so as to interpose the liquid crystal 3 therebetween. However, the liquid crystal display panel P may have a configuration in which one substrate is provided with both the pixel electrodes 2 and the common electrode 6, and an electric field generated by the pixel electrodes 2 and the common electrode 6 controls the orientation of the liquid crystal 3. The liquid crystal 3 may be a liquid crystal other than the polymer dispersed liquid crystal. When the liquid crystal 3 is a liquid crystal other than the polymer dispersed liquid crystal, the light source device L is provided, for example, as a backlight on the back surface side of the liquid crystal display panel P.

The following describes a mechanism for controlling the potentials of the pixel electrodes 2 and the common electrode 6. As illustrated in FIG. 1, the switching element 1 is a switching element using, for example, a semiconductor, such as a thin-film transistor (TFT). One of the source and the drain of the switching element 1 is coupled to one of the two electrodes (pixel electrode 2). The other of the source and the drain of the switching element 1 is coupled to a signal line 4. The gate of the switching element 1 is coupled to a scan line 5. The scan line 5 applies a potential for opening and closing a circuit between the source and the drain of the switching element 1 under the control by the scan circuit 9. The scan circuit 9 controls the potential. The control of the potential by the scan circuit 9 will be described later in detail.

In the example illustrated in FIG. 1, a plurality of the signal lines 4 are arranged along one of the arrangement directions of the pixels Pix (along the row direction). The signal lines 4 extend along the other of the arrangement directions of the pixels Pix (along the column direction). Each of the signal lines 4 is shared by corresponding ones of the switching elements 1 of the pixels Pix arranged in the column direction. A plurality of the scan lines 5 are arranged along the column direction. The scan lines 5 extend along the row direction. Each of the scan lines 5 is shared by corresponding ones of the switching elements 1 of the pixels Pix arranged in the row direction.

The common electrode 6 is coupled to the VCOM drive circuit 10. The VCOM drive circuit 10 applies a reference potential to the common electrode 6. The signal output circuit 8 outputs a pixel signal to the signal line 4 at a time when the scan circuit 9 applies a potential (first potential) serving as a drive signal to the scan line 5, so as to charge the liquid crystal (fine particles 52) serving as a storage capacitor and a capacitive load formed between the pixel electrodes 2 and the common electrode 6. This operation sets a voltage of the pixel Pix to a voltage corresponding to the pixel signal. After the application of the first potential is completed, the liquid crystal (fine particles 52) serving as the storage capacitor and the capacitive load hold the pixel signal. The orientation of the liquid crystal (fine particles 52) is controlled in accordance with the electric field generated by the voltage of each of the pixels Pix and the voltage of the common electrode 6.

The light source device L provided with a light source 11 is disposed at a side surface of the display device 100 according to the present embodiment. The light source 11 includes a first light source 11R that emits red light, a second light source 11G that emits green light, and a third light source 11B that emits blue light. Each of the first light source 11R, the second light source 11G, and the third light source 11B emits light under the control of a light source drive circuit 12. Each of the first light source 11R, the second light source 11G, and the third light source 11B of the first embodiment is a light source using, for example, a light-emitting element such as a light-emitting diode (LED), but is not limited thereto, and only needs to be a light source controllable in light emission timing. The light source drive circuit 12 controls the light emission timing of the first light source 11R, the second light source 11G, and the third light source 11B under the control of the timing controller 13.

The timing controller 13 controls timing of the signal output circuit 8, the scan circuit 9, the VCOM drive circuit 10, and the light source drive circuit 12. In the first embodiment, field sequential control is performed.

Figure 3:
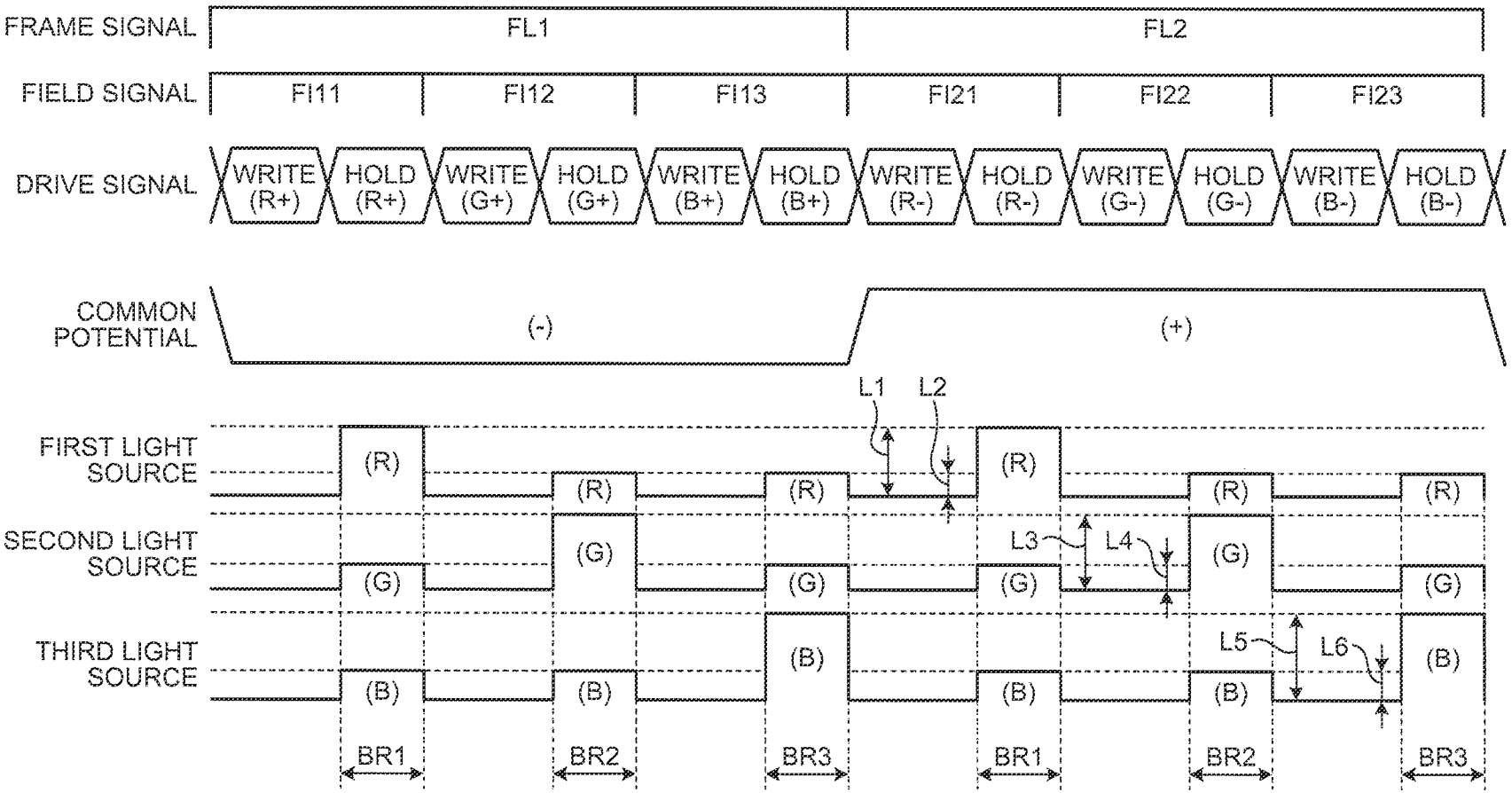
FIG. 3 is a timing diagram illustrating an example of a flow of field sequential control according to a first embodiment.

FIG. 3 is a timing diagram illustrating an example of a flow of the field sequential control according to the first embodiment. FIG. 3 illustrates the schematic timing diagram of two frame periods. The timing diagram of FIG. 3 includes information on output timing of a frame signal, output timing of a field signal, switching timing of the drive signal, switching timing of the common potential, and lighting timing of the first light source 11R, the second light source 11G, and the third light source 11B. The switching timing of the drive signal represents switching timing of the potential of the scan line 5. The switching timing of the common potential represents switching timing of the potential of the common electrode 6.

The frame signal is a signal representing start timing of each frame period. FIG. 3 illustrates that the frame signal is output when a first frame period FL1 starts, when a second frame period FL2 starts, and when the next frame (third frame) period starts after the end of the second frame period.

The field signal is a signal representing start timing of field periods included in each frame period. Each frame period includes a number of the field periods corresponding to the number of colors of the light emitted from the light source 11. FIG. 3 illustrates that the field signal is output when a first field period FI11, a second field period FI12, and a third field period FI13 included in the first frame period FL1 start, when a first field period FI21, a second field period FI22, and a third field period FI23 included in the second frame period FL2 start, and when a first field period of the next frame (third frame) period starts after the end of the second frame period.

Each of the field periods includes a writing period of the pixel signal and a holding period of the pixel signal held by the storage capacitor. In FIG. 3, WRITE (R+) represents the writing period of the first field period FI11; HOLD (R+) represents the holding period of the first field period FI11; WRITE (G+) represents the writing period of the second field period FI12; HOLD (G+) represents the holding period of the second field period FI12; WRITE (B+) represents the writing period of the third field period FI13; HOLD (B+) represents the holding period of the third field period FI13; WRITE (R−) represents the writing period of the first field period FI21; HOLD (R−) represents the holding period of the first field period FI21; WRITE (G−) represents the writing period of the second field period FI22; HOLD (G−) represents the holding period of the second field period FI22; WRITE (B−) represents the writing period of the third field period FI23; and HOLD (B−) represents the holding period of the third field period F123. The writing period is a period in which the TFTs are sequentially turned on to write the pixel signals for each row. The holding period is period in which all the TFTs are turned off to hold the voltages written in the writing period.

The writing period included in each of the field periods in one frame period is a period for writing the pixel signal corresponding to a gradation value of a corresponding one of the different colors. For example, the pixel signals of the first frame are assumed to be represented by red-green-blue (RGB) gradation values as (R, G, B)=(r1, g1, b1). The value r1 represents the gradation value of red (R) in an input signal including the information representing the RGB gradation values. The value g1 represents the gradation value of green (G) in the input signal including the information representing the RGB gradation values. The value b1 represents the gradation value of blue (B) in the input signal including the information representing the RGB gradation values. In this case, the pixel signal corresponding to the gradation value r1 is written in the writing period of the first field period FI11. The pixel signal corresponding to the gradation value g1 is written in the writing period of the second field period FI12. The pixel signal corresponding to the gradation value b1 is written in the writing period of the third field period FI13. The holding periods included in the field periods in one frame period are periods for holding the pixel signals corresponding to the gradation values of the different colors. The writings of the pixel signals as described above are individually performed for each of the pixels Pix in each of the field periods. The RGB gradation values in the pixel signal for each of the pixels Pix correspond to an image output to be displayed.

Each of the light sources (for example, the first light source 11R, the second light source 11G, and the third light source 11B) for a plurality of colors included in the light source 11 is controlled so as to be lit at least during the holding period of the corresponding field period. For example, the first light source 11R is a red light source, the second light source 11G is a green light source, and the third light source 11B is a blue light source. For example, in the first frame period FL1, the first light source 11R is lit during a first light emission period BR1 corresponding to the holding period of the first field period FI11. In this way, each of the pixels Pix can perform color display by lighting the light sources of different colors for each of the field periods.

In the first embodiment, the second light source 11G and the third light source 11B are also lit in addition to the first light source 11R during the first light emission period BR1. The luminance of the first light source 11R during the first light emission period BR1 is higher than the luminance of the second light source 11G during the first light emission period BR1 and the luminance of the third light source 11B during the first light emission period BR1. In the example illustrated in FIG. 3, the luminance of the first light source 11R during the first light emission period BR1 is luminance L1. The luminance of the second light source 11G during the first light emission period BR1 is luminance L4. The luminance of the third light source 11B during the first light emission period BR1 is luminance L6. The luminance L1 is higher than the luminance L4 and the luminance L6. As a result, scattered light looking red is emitted corresponding to the gradation value (r1) of red (R) written during the writing period of the first field period FI11. In the example illustrated in FIG. 3, the luminance L4 is equal to the luminance L6, but may differ from luminance L6. However, the luminance L1 remains to be higher than the luminance L4 and the luminance L6 even if the luminance L4 differs from the luminance L6.

In the first frame period FL1, the second light source 11G is lit during a second light emission period BR2 corresponding to the holding period of the second field period FI12. In the first embodiment, the first light source 11R and the third light source 11B are also lit in addition to the second light source 11G during the second light emission period BR2. The luminance of the second light source 11G during the second light emission period BR2 is higher than the luminance of the first light source 11R during the second light emission period BR2 and the luminance of the third light source 11B during the second light emission period BR2. In the example illustrated in FIG. 3, the luminance of the second light source 11G during the second light emission period BR2 is luminance L3. The luminance of the first light source 11R during the second light emission period BR2 is luminance L2. The luminance of the third light source 11B during the second light emission period BR2 is the luminance L6. The luminance L3 is higher than the luminance L2 and the luminance L6. As a result, scattered light looking green is emitted corresponding to the gradation value (g1) of green (G) written during the writing period of the second field period FI12. In the example illustrated in FIG. 3, the luminance L2 is equal to the luminance L6, but may differ from the luminance L6. However, the luminance L3 remains to be higher than the luminance L2 and the luminance L6 even if the luminance L2 differs from the luminance L6.

In the first frame period FL1, the third light source 11B is lit daring a third light emission period BR3 corresponding to the holding period of the third field period FI13. In the first embodiment, the first light source 11R and the second light source 11G are also lit in addition to the third light source 11B during the third light emission period BR3. The luminance of the third light source 11B during the third light emission period BR3 is higher than the luminance of the first light source 11R during the third light emission period BR3 and the luminance of the second light source 11G during the third light emission period BR3. In the example illustrated in FIG. 3, the luminance of the third light source 11B during the third light emission period BR3 is luminance L5. The luminance of the first light source 11R during the third light emission period BR3 is luminance 12. The luminance of the second light source 11G during the third light emission period BR3 is luminance L4. The luminance L5 is higher than the luminance L2 and the luminance L4. As a result, scattered light looking blue is emitted corresponding to the gradation value (b1) of blue (B) written during the writing period of the third field period FI13. In the example illustrated in FIG. 3, the luminance L2 is equal to the luminance L4, but may differ from the luminance L4. However, the luminance L5 remains to be higher than the luminance L2 and the luminance L4 even if the luminance L2 differs from the luminance L4.

The luminance L1 of the main light source (first light source 11R) during the first light emission period BR1, the luminance L3 of the main light source (second light source 11G) during the second light emission period BR2, and the luminance L5 of the main light source (third light source 11B) during the third light emission period BR3 need not be the same luminance, and are set as appropriate.

The light emission luminance (auxiliary light emission luminance), such as the luminance L2, L4, or L6, of a light source (auxiliary light source) other than the main light source in each of the periods can be represented as a ratio (for example, in a range from 0.01 to 0.5) to the luminance (for example, the luminance L1, L3, or L5) in the period in which the auxiliary light source serves as the main light source. For example, power consumption can be reduced while limiting a reduction in display quality within an allowable range by setting the light emission amount (L4/L3) of the second light source 11G during the first light emission period BR1 to 0.1 to 0.5, and setting the light emission amount (L6/L5) of the third light source 11B during the first light emission period BR1 to 0.1 to 0.4. The power consumption can be reduced while limiting the reduction in display quality within the allowable range by setting the light emission amount (L2/L1) of the first light source 11R during the second light emission period BR2 to 0.02 to 0.15, and setting the light emission amount (L6/L5) of the third light source 11B during the second light emission period BR2 to 0.1 to 0.3. The power consumption can be reduced while limiting the reduction in display quality within the allowable range by setting the light emission amount (L2/L1) of the first light source 11R during the third light emission period BR3 to 0.1 to 0.5, and setting the light emission amount (L4/L3) of the second light source 11G during the third light emission period BR3 to 0.1 to 0.5.

A light source of at least one color may emit light as an auxiliary light source when the main light source emits light. At this time, the auxiliary light emission luminance can be represented as a ratio (for example, in a range from 0.01 to 0.5) to the luminance in the period in which the auxiliary light source serves as the main light source. For example, the power consumption can be reduced while limiting the reduction in display quality within the allowable range by setting the light emission amount (L4/L3) of the second light source 11G during the first light emission period BR1 to 0.1 to 0.5, and setting the light emission amount (L6/L5) of the third light source 11B during the first light emission period BR1 to substantially 0. The power consumption can be reduced while limiting the reduction in display quality within the allowable range by setting the light emission amount (L2/L1) of the first light source 11R during the second light emission period BR2 to 0, and setting the light emission amount (L6/L5) of the third light source 11B during the second light emission period BR2 to 0.05 to 0.3. The power consumption can be reduced while limiting the reduction in display quality within the allowable range by setting the light emission amount (L2/L1) of the first light source 11R during the third light emission period BR3 to 0.1 to 0.5, and setting the light emission amount (L4/L3) of the second light source 11G during third light emission period BR3 to substantially 0.

Figure 4:
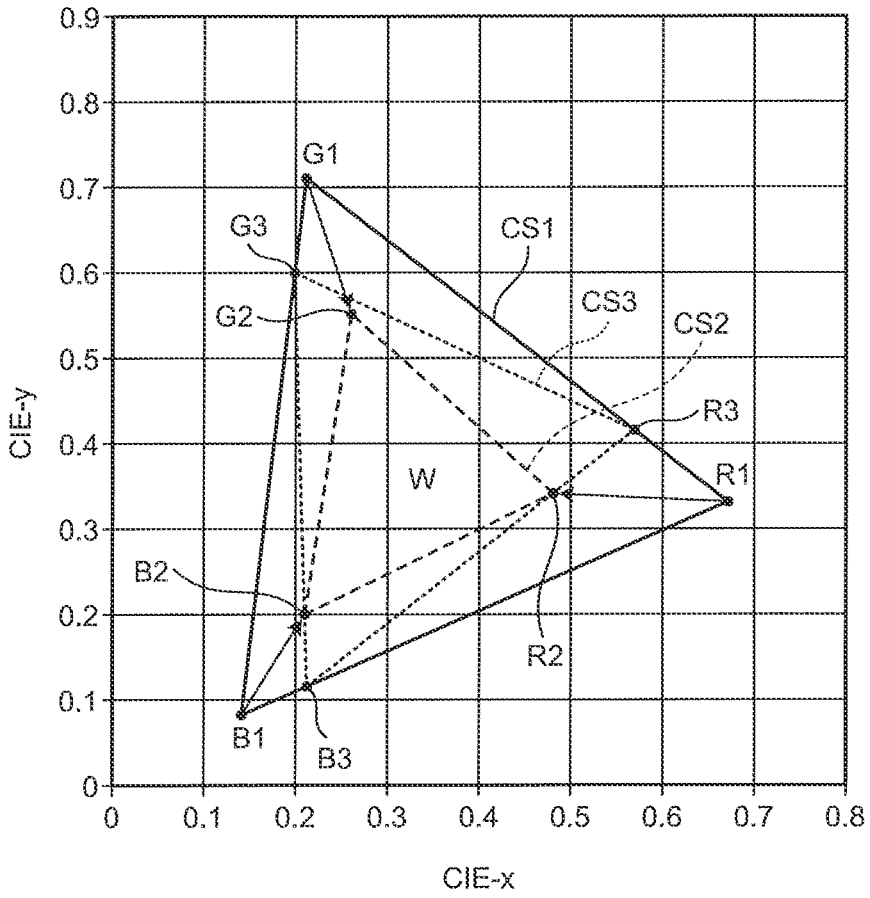
FIG. 4 is a diagram schematically illustrating color gamuts employable by the display system using a CIExy chromaticity diagram.

FIG. 4 is a diagram schematically illustrating color gamuts CS1, CS2, and CS3 employable by the display system 300 using a CIExy chromaticity diagram. For example, the color gamut CS1 contained in a frame obtained by connecting a first red color R1 reproduced when only the first light source 11R is lit during the first light emission period BR1, a first green color G1 reproduced when only the second light source 11G is lit during the second light emission period BR2, and a first blue color B1 reproduced when only the third light source 11B is lit during the third light emission period BR3. In other words, the color of the light of the first light source 11R corresponds to the first red color R1; the color of the light of the second light source 11G corresponds to the first green color G1; and the color of the light of the third light source 11B corresponds to the first blue color B1. In the first embodiment, however, as described with reference to FIG. 3, during the first light emission period BR1, the second light source 11G and the third light source 11B are lit in addition to the first light source 11R to reproduce a second red color R2. The second red color R2 has higher luminance than the first red color R1 because the luminance of the second light source 11G and the third light source 11B is added. The addition of the luminance of the second light source 11G and the third light source 11B causes the saturation of the second red color R2 as a red color to be lower than that of the first red color R1. In the first embodiment, during the second light emission period BR2, the first light source 11R and the third light source 11B are lit in addition to the second light source 11G to reproduce a second green color G2. The second green color G2 has higher luminance than the first green color G1 because the luminance of the first light source 11R and the third light source 11B is added. The addition of the luminance of the first light source 11R and the third light source 11B causes the saturation of the second green color G2 as a green color to be lower than that of the first green color G1. In the first embodiment, during the third light emission period BR3, the first light source 11R and the second light source 11G are lit in addition to the third light source 11B to reproduce a second blue color B2. The second blue color B2 has higher luminance than the first blue color B1 because the luminance of the first light source 11R and the second light source 11G is added. The addition of the luminance of the first light source 11R and the second light source 11G causes the saturation of the second blue color B2 as a blue color to be lower than that of the first blue color B1. The first embodiment employs the color gamut CS2 in a frame obtained by connecting the second red color R2, the second green color G2, and the second blue color B2 described above. Employing the color gamut CS2 causes the luminance of a display screen of the display device 100 to be higher than that in the case of employing the color gamut CS1.

As described above, one frame period includes the writing and holding of the pixel signal of R, g, and B as well as the illumination in which the light sources of the colors corresponding to the pixel signal of R, G, and B are lit at relatively high luminance, so that the color reproduction in the color gamut CS2 is performed. The color reproduction is performed with the same mechanism in the second frame period FL2 and periods after the second frame period FL2.

The frequency of the field period is obtained by multiplying the frequency of the frame period by the number of colors of the light emitted by the light source 11. In the first embodiment, the frequency of the frame period is, for example, 60 Hz. However, the frequency of the frame period is not limited thereto, and may be 120 Hz or another frequency. When the frequency of the frame period is 60 Hz, the frequency of the field period is 180 Hz in the first embodiment. However, the frequency of the field period can be changed as appropriate in accordance with the frequency of the frame period and/or the number of colors of the light emitted by the light source 11.

FIG. 3 illustrates that the length of the writing period is apparently the same as that of the holding period. However, the holding period is actually longer than the writing period.

In the liquid crystal display panel P using the liquid crystal, inversion driving is performed to invert relative levels of potentials of two electrodes at a predetermined period. In FIG. 3, the VCOM drive circuit 10 controls the potential of the common electrode 6 so as to set the common potential to a negative (−) potential in the first frame period FL1, and set the common potential to a positive (+) potential in the second frame period FL2. In response to this operation, the pixel signal is written so as to set the potential of the pixel electrode 2 to a positive (+) potential in the first frame period FL1, and the pixel signal is written so as to set the potential of the pixel electrode 2 to a negative (−) potential in the second frame period FL2. Symbols in a parenthesis in an explanation of the drive signal illustrated in FIG. 3 represent a combination of the colors of the RGB gradation values corresponding to the written pixel signal with the potential.

In the first embodiment, in each of the pixels Pix, the potential of the pixel electrode 2 is controlled for the inversion driving. Specifically, the signal output circuit 8 outputs the pixel signal for the inversion driving to the signal line 4. In other words, the signal output circuit 8 outputs the pixel signal such that a voltage between the pixel electrode 2 and the common electrode 6 changes in polarity without changing its amplitude in accordance with timing at which the common electrode 6 is driven to be inverted. The VCOM drive circuit 10 switches the potential of the common electrode 6 for the inversion driving. The timing controller 13 synchronizes timing at which an inversion drive circuit switches the potential of the pixel electrode 2 with the timing at which the VCOM drive circuit 10 switches the potential of the common electrode 6, at a cycle of a frame period. These circuits serve as an inversion driver of the first embodiment.

In the example illustrated in FIG. 3, the inversion driving is performed at a cycle of a frame period such that the potential of the pixel electrode 2 is relatively higher than that of the common electrode 6 in the first frame period FL1, and the potential of the pixel electrode 2 is relatively lower than that of the common electrode 6 in the second frame period FL2. However, this example is merely a specific control example of the inversion driving method. The inversion driving method is not limited to this example. For example, the relative levels of potentials of the pixel electrode 2 and the common electrode 6 may be inverted at a cycle of a plurality of frame periods.

An image signal (RGB data) serving as a source of the pixel signals is supplied to the liquid crystal display panel P through an input circuit 15 included in the control device 200. The input circuit 15 outputs, to the signal output circuit 8, signals representing the gradation values of the colors of red (R), green (G), and blue (B) of the respective pixels Pix based on the image signal. The input circuit 15 also outputs, to the timing controller 13, control signals including, among others, a synchronization signal synchronized with timing of the signals input to the signal output circuit 8. The timing controller 13 controls operations of, for example, the signal output circuit 8, the scan circuit 9, and the VCOM drive circuit 10 based on the signals received from the input circuit 15.

The light source drive circuit 12 operates under the timing control of the timing controller 13. Either of the display device 100 and the control device 200 may serve as a controller of the luminance of each of the first light source 11R, the second light source 11G, and the third light source 11B that are lit under the control of the light source drive circuit 12. In other words, the light source drive circuit 12 may hold luminance control parameters for lighting the first light source 11R, the second light source 11G, and the third light source 11B, for example, in the relation between the luminance values L1, L2, L3, L4, L5, and L6 described with reference to FIG. 3. Alternatively, the luminance control parameters may be output from the input circuit 15 of the control device 200 to the display device 100. When the luminance control parameters are output from the input circuit 15 of the control device 200 to the display device 100, the luminance control parameters may be supplied to the light source drive circuit 12 through the timing controller 13, or may be directly supplied from the input circuit 15 to the light source drive circuit 12 without passing through the timing controller 13.

Although, in FIG. 1, the input circuit 15 is provided in the control device 200 independent from the display device 100, the input circuit 15 may be provided in the liquid crystal display panel P. The input circuit 15 may be provided as a function of a display driver integrated circuit (DDIC) designed so as to integrate other circuits, for example, the timing controller 13.

According to the first embodiment, the first light source 11R, the second light source 11G, and the third light source 11B emit light in each of the first light emission period BR1, the second light emission period BR2, and the third light emission period BR3. During the first light emission period BR1, the luminance of the first light source 11R is higher than the luminance of the second light source 11G and the luminance of the third light source 11B. During the second light emission period BR2, the luminance of the second light source 11G is higher than the luminance of the first light source 11R and the luminance of the third light source 11B. During the third light emission period BR3, the luminance of the third light source 11B is higher than the luminance of the first light source 11R and the luminance of the second light source 11G. As a result, the display output can be performed using the color gamut CS2 that enables both the color reproduction corresponding to the colors of the light of the first light source 11R, the second light source 11G, and the third light source 11B and securement of the luminance.

Accordingly, the luminance can be increased more easily than in the case where only a light source of a color corresponding to the gradation value of the pixel signal supplied in each of the field periods is lit.

As illustrated in FIG. 3, the luminance can be increased without changing a hue by setting the luminance of the second light source 11G equal to the luminance of the third light source 11B during the first light emission period BR1, setting the luminance of the first light source 11R equal to the luminance of the third light source 11B during the second light emission period BR2, and setting the luminance of the first light source 11R equal to the luminance of the second light source 11G during the third light emission period BR3.

The hue can be adjusted while simultaneously increasing the luminance by setting the luminance of the second light source 11G different from the luminance of the third light source 11B during the first light emission period BR1, setting the luminance of the first light source 11R different from the luminance of the third light source 11B during the second light emission period BR2, and setting the luminance of the first light source 11R different from the luminance of the second light source 11G during the third light emission period BR3.

Second Embodiment

Figure 5:
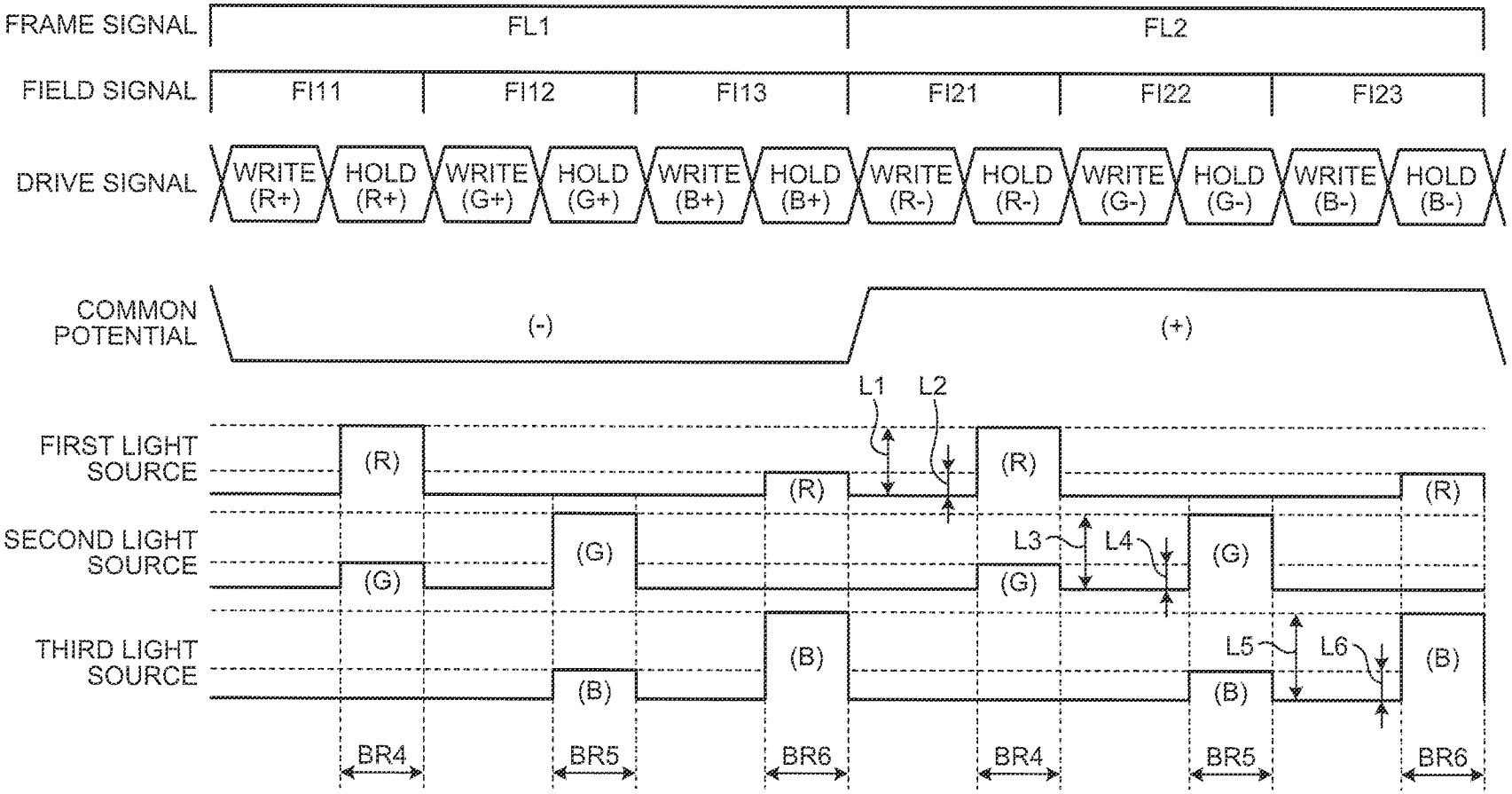
FIG. 5 is a timing diagram illustrating an example of the flow of the field sequential control according to a second embodiment.

The following describes the display device according to a second embodiment with reference to FIGS. 4 and 5. The configuration of the second embodiment is the same as the configuration of the first embodiment except for specially mentioned items.

FIG. 5 is a timing diagram illustrating an example of the flow of the field sequential control according to the second embodiment. In the second embodiment, during a first light emission period BR4, one of the second light source 11G and the third light source 11B is lit in addition to the first light source 11R, but the other thereof is not lit. The luminance of the first light source 11R during the first light emission period BR4 is higher than the luminance of the one of the second light source 11G and the third light source 11B. In the example illustrated in FIG. 5, the first light source 11R and the second light source 11G are lit, but the third light source 11B is not lit, during the first light emission period BR4. The luminance of the first light source 11R during the first light emission period BR4 is the luminance L1. The luminance of the second light source 11G during the first light emission period BR4 is the luminance L4. The luminance L1 is higher than the luminance L4.

In the second embodiment, during a second light emission period BR5, one of the first light source 11R and the third light source 11B is lit in addition to the second light source 11G, but the other thereof is not lit. The luminance of the second light source 11G during the second light emission period BR5 is higher than the luminance of the one of the first light source 11R and the third light source 11B. In the example illustrated in FIG. 5, the second light source 11G and the third light source 11B are lit, and the first light source 11R is not lit, during the second light emission period BR5. The luminance of the second light source 11G during the second light emission period BR5 is the luminance L3. The luminance of the third light source 11B during the second light emission period BR5 is the luminance L6. The luminance L3 is higher than the luminance L6.

In the second embodiment, during a third light emission period BR6, one of the first light source 11R and the second light source 11G is lit in addition to the third light source 11B, but the other thereof is not lit. The luminance of the third light source 11B during the third light emission period BR6 is higher than the luminance of the one of the first light source 11R and the second light source 11G. In the example illustrated in FIG. 5, the third light source 11B and the first light source 11R are lit, and the second light source 11G is not lit, during the third light emission period BR6. The luminance of the third light source 11B during the third light emission period BR6 is the luminance L5. The luminance of the first light source 11R during the third light emission period BR6 is the luminance L2. The luminance L5 is higher than the luminance L2.

In the second embodiment, in the same way as in the first embodiment, the luminance L1 of the main light source (first light source 11R) during the first light emission period BR4, the luminance L3 of the main light source (second light source 11G) during the second light emission period BR5, and the luminance L5 of the main light source (third light source 11B) during the third light emission period BR6 need not be the same luminance, and are set as appropriate. The light emission luminance (auxiliary light emission luminance), such as the luminance L2, L4, or L6, of a light source (auxiliary light source) other than the main light source in each of the periods can be represented as a ratio (for example, in a range from 0.01 to 0.5) to the luminance (for example, the luminance L1, L3, or L5) in the period in which the auxiliary light source serves as the main light source. For example, the power consumption can be reduced while limiting the reduction in display quality within the allowable range by setting the light emission amount (L4/L3) of the second light source 11G during the first light emission period BR4 to 0.1 to 0.5. The power consumption can be reduced while limiting the reduction in display quality within the allowable range by setting the light emission amount (L6/L5) of the third light source 11B during the second light emission period BR5 to 0.05 to 0.3. The power consumption can be reduced while limiting the reduction in display quality within the allowable range by setting the light emission amount (L2/L1) of the first light source 11R during the third light emission period BR6 to 0.1 to 0.5.

In the example described with reference to FIG. 5, during the first light emission period BR4, the second light source 11G is lit in addition to the first light source 11R to reproduce a third red color R3 that is closer to the first green color G1 than the first red color R1 is (refer to FIG. 4). During the second light emission period BR5, the third light source 11B is lit in addition to the second light source 11G to reproduce a third green color G3 that is closer to the first blue color B1 than the first green color G1 is (refer to FIG. 4). During the third light emission period BR6, the first light source 11R is lit in addition to the third light source 11B to reproduce a third blue color B3 that is closer to the first red color R1 than the first blue color B1 is (refer to FIG. 4). The second embodiment employing the example described with reference to FIG. 5 employs a color gamut CS3 in a frame obtained by connecting the third red color R3, the third green color G3, and the third blue color B3 described above (refer to FIG. 4), and reproduces colors in the color gamut CS3.

The relation between the one and the other described above with reference to FIG. 5 may be reversed. In other words, for example, the first light source 11R and the third light source 11B may be lit, and the second light source 11G may be unlit, during the first light emission period BR4. During the second light emission period BR5 and the third light emission period BR6, the relation between the one and the other may be reversed in the same way.

According to the second embodiment, the hue can be adjusted by lighting light sources of other colors in addition to a light source of a color corresponding to a color of the pixel signal. The luminance of the display screen can be higher than that in the case where only the light source of the color corresponding to the color of the pixel signal is lit.

Modification

Figure 6:
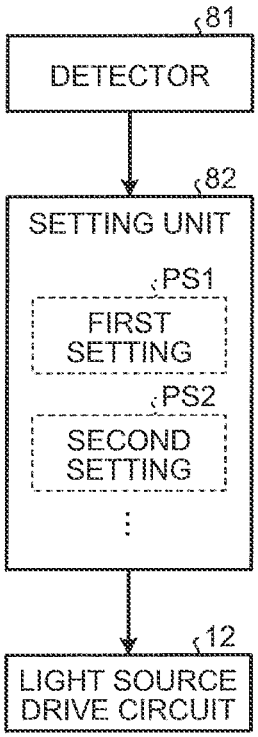
FIG. 6 is a block diagram illustrating a relation between a detector, a setting unit, and a light source drive circuit provided in a modification.

FIG. 6 is a block diagram illustrating a relation between a detector 81, a setting unit 82, and the light source drive circuit 12 provided in a modification. The display system 300 may further include the detector 81 and the setting unit 82 as illustrated in FIG. 6. The detector 81 is an optical sensor that detects brightness of ambient light at a periphery of the display system 300. The periphery of the display system 300 corresponds to at least either one of a periphery of the display device 100 and a periphery of the control device 200, and preferably corresponds to the periphery of the display device 100.

The setting unit 82 includes a circuit that sets amounts of light of the light sources of other colors based on the brightness of the ambient light detected by the detector 81. The term "the light sources of other colors" as used herein refers to the light sources of the other colors that are lit in addition to the light source of the color corresponding to the color of the pixel signal. Specifically, the setting unit 82 holds parameters corresponding to a plurality of settings, for example, a first setting PS1 and a second setting PS2 as illustrated in FIG. 6. The luminance of the light sources of the other colors when being lit is different between the first setting PS1 and the second setting PS2.

The following describes an exemplary case where the luminance of the light sources of the other colors when being lit with the first setting PS1 is higher than that with the second setting PS2. For example, when the ambient light is bright, the display screen is difficult to be viewed if the luminance obtained by the light from the light source device L is low. Therefore, if the brightness of the ambient light detected by the detector 81 is equal to or higher than a predetermined threshold of brightness, the setting unit 82 employs the first setting PS1 to set the luminance of the light sources of the other colors when being lit to the light source drive circuit 12. In other words, if the brightness of the ambient light is equal to or higher than the predetermined threshold, the auxiliary light sources are lit in addition to the main light source. The light source drive circuit 12 determines the luminance L2, L4, and L6 in accordance with the first setting PS1. If the ambient light is dark, the display screen looks relatively brighter than the surroundings and can be easily viewed. In this case, the saturation may be preferred to the luminance. Therefore, if the brightness of the ambient light detected by the detector 81 is lower than the predetermined threshold of brightness, the setting unit 82 employs the second setting PS2 to set the luminance of the light sources of the other colors when being lit to the light source drive circuit 12. The light source drive circuit 12 determines the luminance L2, L4, and L6 in accordance with the second setting PS2. When the second setting PS2 is used, the luminance L2, L4, and L6 may be substantially 0. In other words, if the brightness of the ambient light is lower than the predetermined threshold of brightness, and the saturation may be preferred to the luminance, the above-mentioned auxiliary light sources may be unlit. The predetermined threshold is a value of brightness (for example, a value (also called brightness) of the hue-saturation-value (HSV) model) corresponding to a degree of brightness of the ambient light at which the display screen is difficult to be viewed with the second setting PS2. The predetermined threshold is determined based on, for example, a preliminary measurement taking into account display characteristics (such as hue characteristics) of the liquid crystal display panel P. The steps of the setting based on the brightness of the ambient light are not limited to the two steps: the first setting PS1 and the second setting PS2. Divisions of three or more steps may be provided in the brightness of the ambient light, and presettings for setting the light source device L may be provided corresponding to the number of the divisions. In this case, the setting is made so as to increase the lighting rate of the auxiliary light sources with increase in the brightness of the ambient light.

The detector 81 and the setting unit 82 may be provided in the display device 100 or in the control device 200. Alternatively, the setting unit 82 may be provided in the control device 200, and the detector 81 may be provided in the display device 100. In this case, the setting unit 82 may be integrated with the input circuit 15. In other words, in a configuration in which the luminance is determined under the control of the input circuit 15, the input circuit 15 may use parameters, for example, the first setting PS1 and the second setting PS2, held in the setting unit 82 for the control. As described above, the control device 200 may control, based on the brightness of the ambient light, the luminance of the second light source 11G and the luminance of the third light source 11B in the first light emission period BR1 or BR4, the luminance of the first light source 11R and the luminance of the third light source 11B in the second light emission period BR2 or BR5, and the luminance of the first light source 11R and the luminance of the second light source 11G in the third light emission period BR3 or BR6.

While FIG. 6 illustrates the first setting PS1 and the second setting PS2 among the parameters held in the setting unit 62, three or more kinds of parameters may be used for setting the luminance of the light sources of the other colors when being lit. Criteria of the brightness of the ambient light for selecting which of the settings is to be employed can be set as appropriate based on, for example, preliminary measurements. The modification described above with reference to FIG. 6 is applicable to either of the first and second embodiments.

The combination of the light sources of a plurality of colors included in the light source 11 is not limited to the combination of red (R), green (G), and blue (B). The light source 11 may include, for example, light sources corresponding to respective three colors represented by a combination of cyan, magenta, and yellow.

The light source device L (or a light source device LB) only needs to be capable of illuminating the liquid crystal display panel P, and can be changed as appropriate in the specific arrangement thereof. For example, light sources of a plurality of colors, such as the first light source 11R, the second light source 11G, and the third light source 11B, may be directly arranged on a light emitting surface of the light source 11 for illuminating the liquid crystal display panel P, as schematically illustrated in FIG. 1, or the light source device may be a light source device LA such as that of FIG. 7A or the light source device LB such as that of FIG. 7B, which will be described below.

Figure 7A:
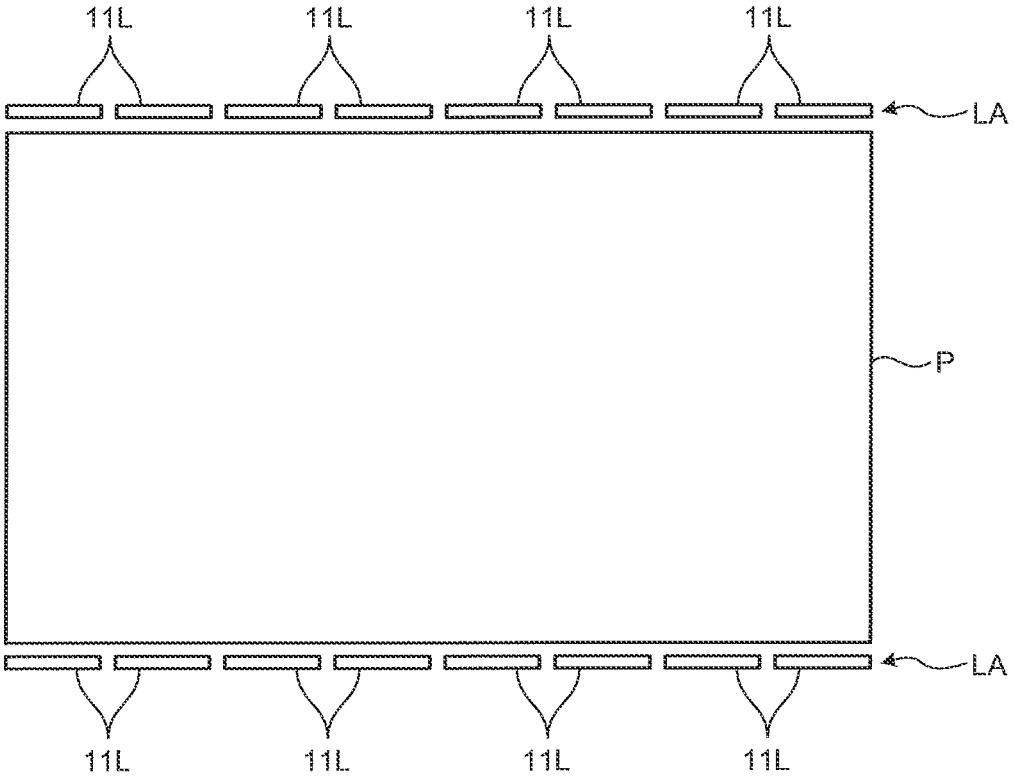
FIG. 7A is a schematic diagram illustrating a configuration example of a light source device.

FIG. 7A is a schematic diagram illustrating a configuration example of the light source device. FIG. 7A illustrates a top view of the configuration example of the light source device. As illustrated in FIG. 7A, the light source device LA includes a plurality of light sources 11L provided in positions facing each other with the liquid crystal display panel P therebetween. The light sources 11L emit light from lateral sides of the liquid crystal display panel P to illuminate the liquid crystal display panel P. The light sources 11L may each include the first light source 11R, the second light source 11G, and the third light source 11B, or the respective light sources 11L may be light sources of different colors. When the respective light sources 11L are light sources of different colors, at least one or more of the light sources of a plurality of colors (for example, red, green, and blue) set as the colors of the light sources is/are provided. In FIG. 7, the light sources 11L are provided in the positions facing each other with the liquid crystal display panel P therebetween, the light sources 11L may be provided on only one side surface of the liquid crystal display panel P.

Figure 7B:
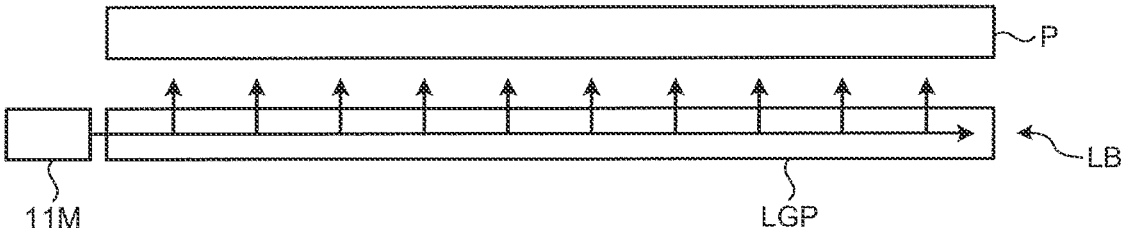
FIG. 7B is a schematic diagram illustrating a configuration example of another light source device.

FIG. 7B is a schematic diagram illustrating a configuration example of the light source device LB. FIG. 7B illustrates a cross-sectional view of the configuration example of the light source device. As illustrated in FIG. 7B, the configuration may be employed in which a multicolor light source 11M is disposed on a lateral side of a light guide plate LGP provided on the back surface of the liquid crystal display panel P. The multicolor light source 11M includes, for example, light sources corresponding to the respective three colors represented by the above-described combination of the first light source 11R, the second light source 11G, and the third light source 11B or the above-described combination of cyan, magenta, and yellow. The multicolor light source 11M is controlled so as to emit light of colors different among the field periods in each of the frame periods.

Other operational advantages accruing from the aspects described in the embodiments herein that are obvious from the description herein, or that are appropriately conceivable by those skilled in the art will naturally be understood as accruing from the present invention.

What is claimed is:

1. A display system comprising:

a display device that comprises a liquid cry seal display panel in which a liquid crystal is sealed between two substrates facing each other, and a first light source, a second light source, and a third light source configured to emit light in colors different from one another; and a control device configured to control the first to third light sources to emit light such that saturation of color obtained by causing the first to third light sources to emit light in a first light emission period is lower than saturation of color obtained by causing only the first light source to emit light, saturation of color obtained by causing the first to third light sources to emit light in a second light emission period is lower than saturation of color obtained by causing only the second light source to emit light, and saturation of color obtained by causing the first to third light sources to emit light in a third light emission period is lower than saturation of color obtained by causing only the third light source to emit light.

2. The display system according to claim 1, wherein the control device is configured to control the light emission of the second light source and the third light source during the first light emission period, control the light emission of the first light source and the third light source during the second light emission period, and control the light emission of the first light source and the second light source during the third light emission period.

3. The display system according to claim 2, wherein the display device or the control device comprises a detector configured to detect brightness of ambient light, and wherein the control device is configured to control, based on the brightness of the ambient light, luminance of the second light source and luminance of the third light source during the first light emission period, luminance of the first light source and the luminance of the third light source during the second light emission period, and the luminance of the first light source and the luminance of the second light source during the third light emission period.

4. The display system according to claim 1, wherein the control device is configured to control the light emission of the second light source or the third light source during the first light emission period, control the light emission of the first light source or the third light source during the second light emission period, and control the light emission of the first light source or the second light source during the third light emission period.

5. The display system according to claim 1, wherein the first light source is configured to emit red light, wherein the second light source is configured to emit green light, and wherein the third light source is configured to emit blue light.

* * * * *